US008662826B2

(12) United States Patent
Willett, Jr. et al.

(10) Patent No.: US 8,662,826 B2
(45) Date of Patent: Mar. 4, 2014

(54) COOLING CIRCUIT FOR A DRUM ROTOR

(75) Inventors: Fred Thomas Willett, Jr., Burnt Hills, NY (US); William Edward Adis, Scotia, NY (US)

(73) Assignee: General Electric Company, Schenectady, NY (US)

( * ) Notice: Subject to any disclaimer, the term of this patent is extended or adjusted under 35 U.S.C. 154(b) by 609 days.

(21) Appl. No.: 12/966,490

(22) Filed: Dec. 13, 2010

(65) Prior Publication Data

US 2012/0148405 A1 Jun. 14, 2012

(51) Int. Cl.
*F01D 5/08* (2006.01)

(52) U.S. Cl.
USPC ..... 415/116; 416/97 R

(58) Field of Classification Search
USPC ..... 415/115, 116; 416/96 A, 97 R, 215, 416/219 R
See application file for complete search history.

(56) References Cited

U.S. PATENT DOCUMENTS

| | | | | | |
|---|---|---|---|---|---|
| 2,656,147 | A | * | 10/1953 | Denison et al. | 416/97 R |
| 3,551,068 | A | * | 12/1970 | Allen et al. | 415/173.7 |
| 4,084,922 | A | * | 4/1978 | Glenn | 416/220 R |
| 4,094,615 | A | * | 6/1978 | Glenn | 416/215 |
| 4,551,063 | A | | 11/1985 | Raschke et al. | |
| 5,593,274 | A | * | 1/1997 | Carreno et al. | 415/115 |
| 7,086,828 | B2 | | 8/2006 | Haje et al. | |
| 7,101,144 | B2 | | 9/2006 | Haje et al. | |
| 7,201,564 | B2 | * | 4/2007 | Bolms et al. | 416/97 R |
| 7,488,153 | B2 | * | 2/2009 | Reigl | 415/177 |
| 2012/0244009 | A1 | * | 9/2012 | Willett, Jr. | 416/96 A |

* cited by examiner

*Primary Examiner* — Nathaniel Wiehe
*Assistant Examiner* — Woody A Lee, Jr.
(74) *Attorney, Agent, or Firm* — Ernest G. Cusick; Frank A. Landgraff

(57) ABSTRACT

A cooling circuit for a drum rotor of a multi-stage steam turbine including tangential female dovetail slots in the drum rotor for tangential entry dovetailed buckets. Axial female dovetail slots are cut into drum rotor projections between stages of the tangential entry buckets for mounting axial inserts. The axial inserts may include axial and radial cooling passages allowing cooler external steam to cool the drum rotor flow through tangential cooling spaces between the tangential female dovetail slots and the tangential entry dovetailed buckets.

15 Claims, 8 Drawing Sheets

COOLING CIRCUIT FOR A DRUM ROTOR

BACKGROUND OF THE INVENTION

The invention relates generally to steam turbines with drum rotors and more specifically to cooling for the drum rotor.

Advanced combined-cycle power plants rely on higher steam temperatures to operate at peak efficiency. High reaction designs using drum rotor construction must be able to withstand higher steam temperatures without compromising rotor life. One solution is to use better, more temperature-resistant, rotor materials. A less costly solution may be to cool the rotor with low temperature steam.

FIG. 1 illustrates a longitudinal cross-sectional view of a steam turbine 5 with a drum rotor 10 and a turbine casing 15 with multiple stages 16, 17, 18, 19, 20 comprised of alternating rows of stator vanes 25 extending inward radially from the turbine casing 15 and rotor blades 26 of rotor buckets 24 where the blades extend outward radially from male dovetailed roots 27 mounted in tangential female dovetail slots 30 cut around the periphery of the drum rotor 10. Working steam 21 flows from steam inlet 22 sequentially through the stages 16, 17, 18, 19, 20 of the alternating stator vanes 25 and rotor blades 26 causing steam temperature and pressure to decrease. The initial stages of the drum rotor 10 are thus exposed to the highest temperature and pressure steam. A packing head 28 seals the end of drum rotor 10 with packing elements 29.

In one prior art approach, external cooling steam 35 is delivered to the drum rotor 10 from an external source 36, as illustrated in FIG. 2. Here, the external source 36 may make use of a snout 37, which penetrates the turbine casing 15. The snout is shown here entering the packing head 28. One or more snouts may be used. The external cooling steam 35 is fed through a passage. The packing head 28 could be designed such that passage is a straight radial hole. Alternatively, the packing head 28 could be designed as an assembly to enable a more complicated passage. The cooling steam 35 is delivered to an outlet 39 and fills an annulus 40. A labyrinth seal, brush seal, or other seal type or combination of seals is employed at locations 41A and or 41B to restrict the leakage of cooling steam 35 into the working steam flow path 21. FIG. 17 illustrates an expanded view of seal arrangements 41 that restrict leakage of the cooling steam into the working steam flow path.

While the path shown in FIG. 2 will provide coolant to the forward side of stage 1 16, it is often necessary to cool multiple stages. Axial steam flow through the drum rotor 10 may be enabled by passages created by axial grooves 44 in the roots of buckets 24 as illustrated in FIG. 3.

Previous concepts have included axial holes 45 in the drum rotor, as illustrated in FIG. 4. Cooling steam 46 passes through the axial holes 45 to flood the circumferential space 48 between the tangential female dovetail slots 30 and the male dovetail roots 27 to reduce the rotor temperature. Unfortunately, long axial holes 45 in the rotor are currently very difficult to produce.

Accordingly, there is a need to provide an effective cooling steam flow path for multiple forward stages of a drum rotor in ways that may be applied with current technology and which do not weaken the rotor.

BRIEF DESCRIPTION OF THE INVENTION

Briefly in accordance with one aspect of the present invention, a multi-stage steam turbine with a steam cooling circuit for multiple front stages of a drum rotor provided. The steam turbine includes a drum rotor with a cooling steam source. A tangential female dovetail slot is cut around an outer radial circumference of one or more stages of the drum rotor. One or more axial female dovetail slots are cut into at least one drum rotor projection across stages of the drum rotor. One or more axial male dovetailed inserts are conformed to insert into the axial female dovetail slots. An axial steam cooling passage is formed either through or around the axial male dovetailed insert.

In accordance with another aspect of the present invention, a cooling circuit for a multi-stage steam turbine with a drum rotor including buckets mounted in tangential female dovetail slots for one or more stage is provided. The cooling circuit includes an external source for a cooling steam supplied to a drum rotor. An internal passage directs the external cooling steam to a space in proximity to the first stage of the steam turbine drum rotor. A tangential female dovetail slot is cut around an outer radial circumference for one or more stages of the drum rotor. Rotor buckets with male dovetails are disposed circumferentially in the tangential female dovetail slot around at least one stage of the rotor wheel. A vane platform on each bucket supports a radially disposed vane. A gap between an outer surface of the male dovetails of the buckets and the inner surface of tangential female dovetail slot provides a circumferential cooling path around the drum rotor projections. One or more axial female dovetail slots are cut into drum rotor projection across stages of the drum rotor. One or more axial male dovetailed insert is conformed to insert into axial female dovetail slots. An axial steam cooling passage is formed through or around the axial male dovetailed insert. The axial steam cooling passage delivers cooling steam to a circumferential cooling path around the drum rotor projections. A vane platform on the buckets may include a cooling passage disposed through the vane platform between the circumferential cooling path and a working steam space above the bucket.

In accordance with a further aspect of the present invention, an axial insert for a cooling circuit for front stages of a steam turbine with a drum rotor is provided. Here the drum rotor includes a tangential female dovetail cut around a circumference of at least one drum rotor stage and at least one axial female dovetail slot cut through at least one drum rotor stage. The insert includes a male axial dovetail insert conformed to insert into the axial female dovetail slots cut through one or more drum rotor stage. An axial steam cooling passage is formed through or around the axial male dovetailed insert. The axial steam cooling passage delivers cooling steam to circumferential cooling path around the drum rotor projections. The axial male dovetailed insert could include multiple axial in-line inserts mounted in a plurality of axial in-line female dovetail slots of the plurality of drum rotor projections or one axial dovetailed insert may extend axially along a plurality of in-line female dovetail slots disposed on multiple rotor projections.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including providing a cooling circuit for a drum rotor of a multi-stage steam turbine including tangential female dovetail slots in the drum rotor for tangential entry dovetailed buckets. Axial female dovetail slots are cut into drum rotor projections across stages of the tangential entry buckets for mounting axial inserts. The axial inserts may include axial and radial cooling passages allowing cooler external steam to cool the drum rotor flow through tangential cooling spaces between the tangential female dovetail slots and the tangential entry dovetailed buckets.

Figure 1:
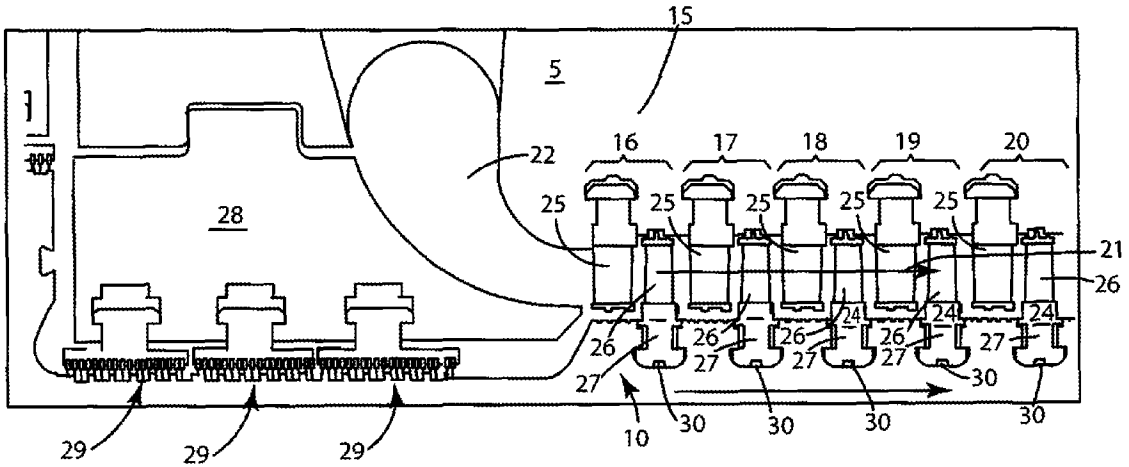
FIG. 1 illustrates a longitudinal cross-sectional view of a prior art steam turbine with a drum rotor.
Figure 2:
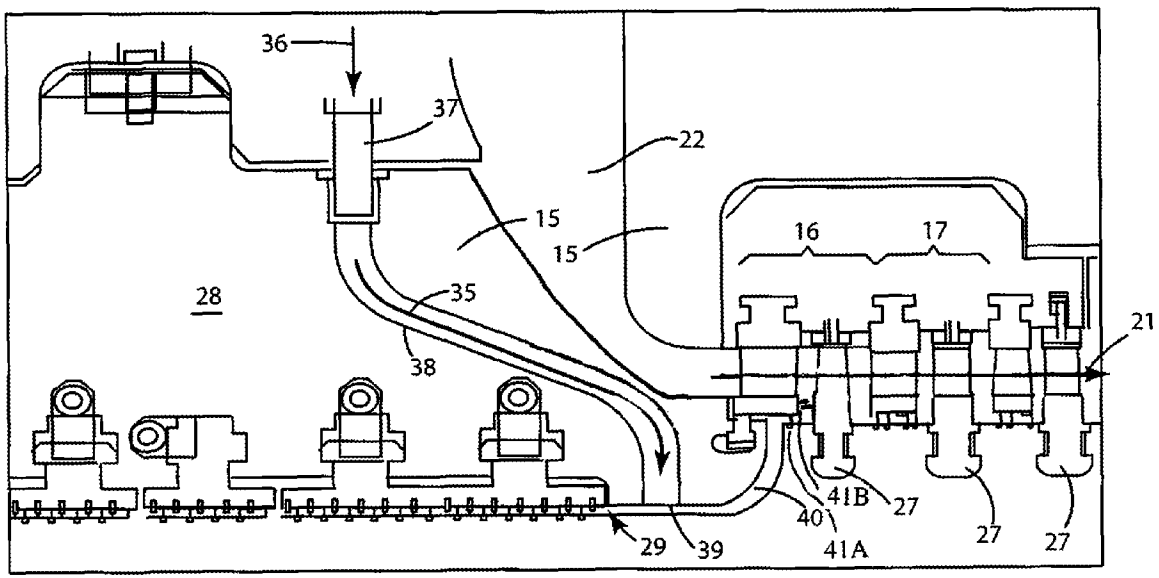
FIG. 2 illustrates a prior art delivery of external cooling steam to a forward side for a first stage of a prior art steam turbine with a drum rotor.
Figure 3:
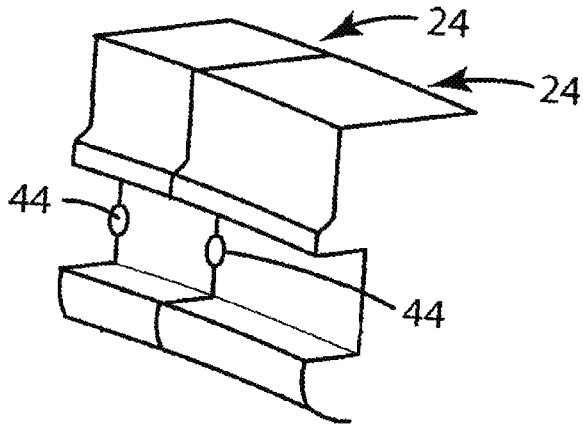
FIG. 3 illustrates axial coolant passages through bucket roots.
Figure 17:
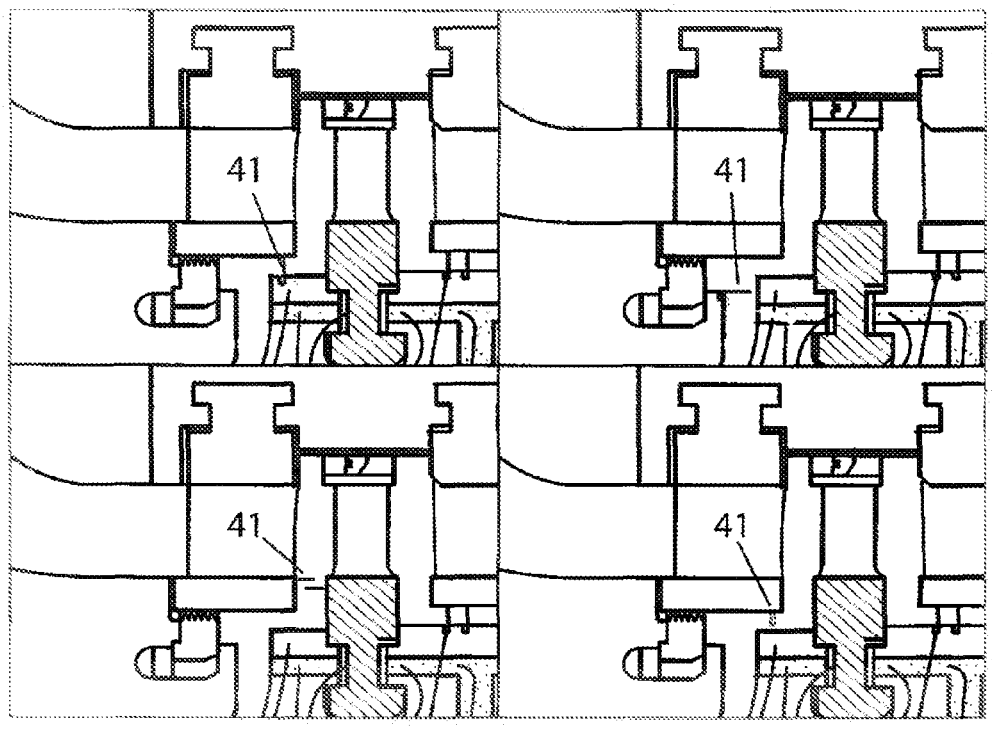
FIG. 17 illustrates an expanded view of various seals that may be used to prevent leakage of cooling steam into the working steam flow path.
Figure 4:
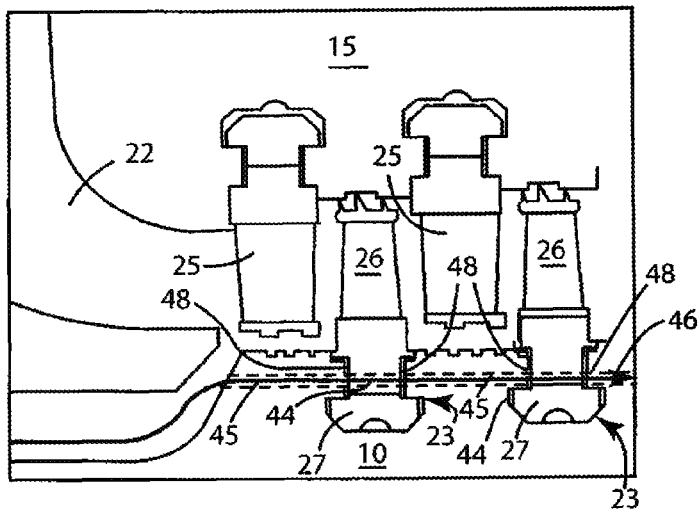
FIG. 4 illustrates long axial passages cut through drum rotor to provide cooling to downstream stages of the drum rotor.
Figure 5:
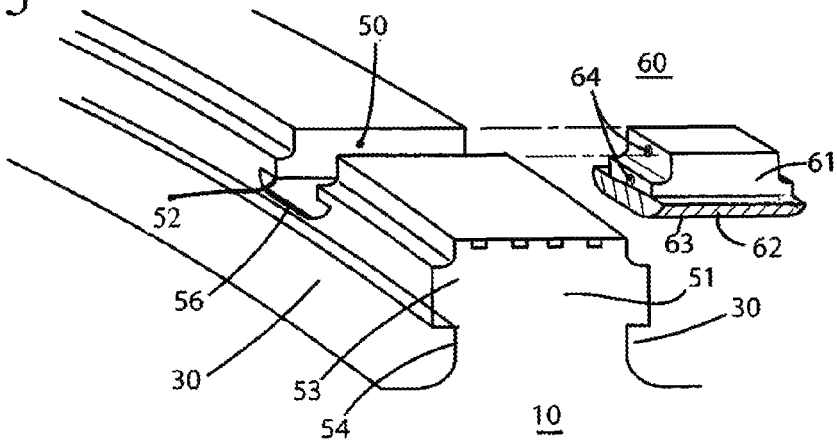
FIG. 5 illustrates axial cooling slots formed in the rotor by dovetailed inserts according to an embodiment of the present invention for application with circumferential dovetails cut into the rotor for tangential entry buckets.

FIG. 5 illustrates axial cooling slots formed in the rotor by dovetailed inserts according to an embodiment of the present invention for application with circumferential dovetails cut into the rotor for tangential entry buckets. An axial female dovetail slot 50 is first cut into rotor body projections 51 between adjacent circumferential dovetails 30 formed for mounting of the tangential entry rotor buckets (not shown). An interlocking portion 52 of the axial female dovetail slot 50 may be formed in a head portion 53 of the rotor body projection 51. An insert 60 may be prepared by machining or other standard techniques to include a male axial dovetail 61, complementary to the female axial dovetail slot 50 but including a cutout portion 62 at a bottom end 63 to provide an axial cooling channel 56 through the rotor body projection when the insert 60 is installed in the female axial dovetail slot 50. In a variation, one or more axial cooling holes 64 may be cut through the axial insert 60 during its fabrication in lieu of or in addition to the axial cooling channel 56 formed between the insert 60 and the axial female dovetail slot 50.

Figure 6:
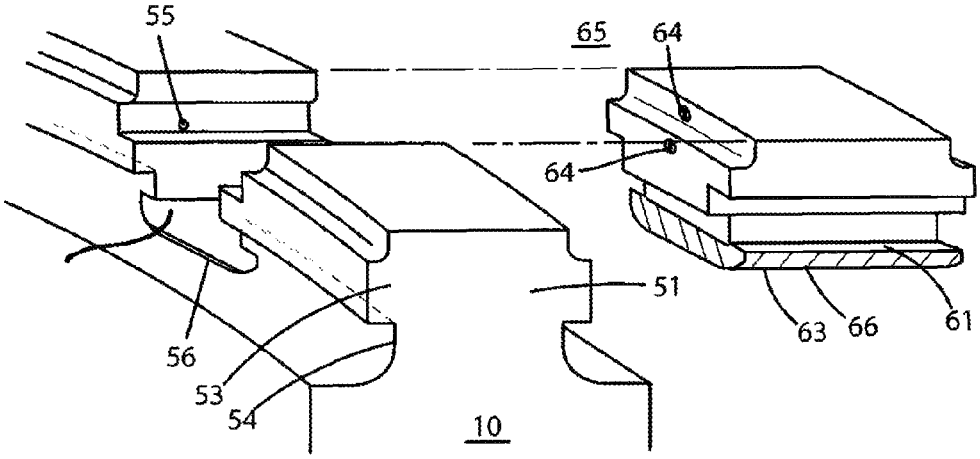
FIG. 6 illustrates axial cooling slots formed in the rotor by dovetailed inserts according to another embodiment of the present invention for application with circumferential dovetails cut into the rotor for tangential entry buckets.

Alternately as shown in FIG. 6, the interlocking portion 52 of the axial female dovetail slot 55 may be formed in the neck portion 54 of the rotor body projection 51. The insert 65 may include a male axial dovetail 61, complementary to the female axial dovetail slot 55 but including a cutout portion 66 at a bottom end 63 to provide an axial cooling channel 56 through the rotor body projection 51 when the insert 65 is installed in the female axial dovetail slot 55. One or more axial cooling holes 64 may be cut through the axial insert 65 during its fabrication in lieu of or in addition to the axial cooling channel 56 formed between the insert 65 and the axial female dovetail slot 55.

Figure 7:
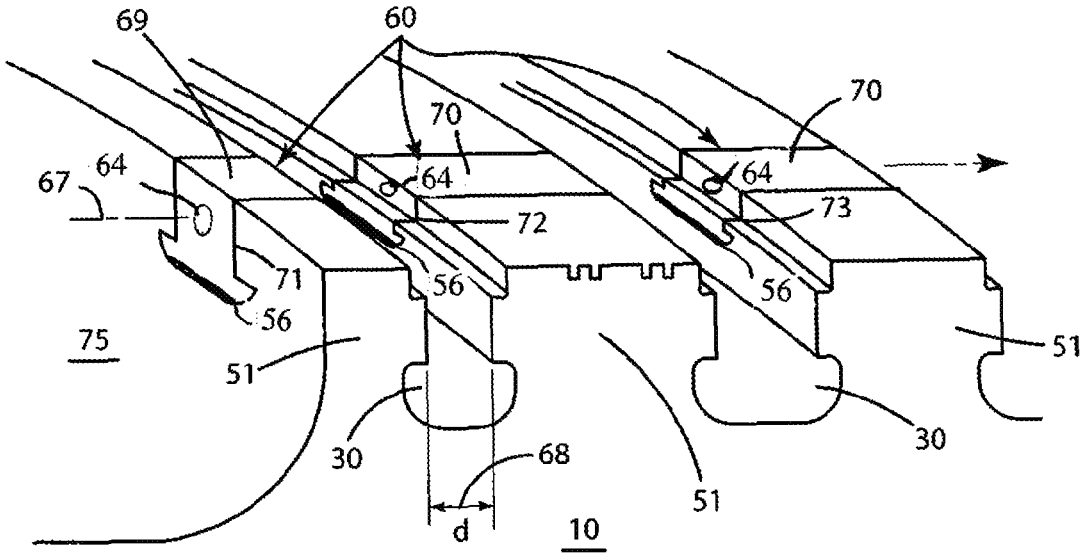
FIG. 7 illustrates that assembly of the axial dovetail inserts is constrained by the smallest space "d" between adjacent rotor body projections.

FIG. 7 illustrates limitations on the axial length of individual axial dovetail inserts 60. A first axial dovetail insert 69 is not restricted in length by space between rotor projections, because the insert 69 may be installed from upstream space 75. The assembly of downstream axial dovetail inserts 70 is constrained by the smallest space "d" 68 between adjacent rotor body projections 51. Any downstream axial insert 70 with a length dimension longer than "d" cannot be installed. Furthermore, the ability to machine the dovetail is also constrained by dimension "d". Locating the axial dovetail inserts 60 in line axially 67 may solve these problems. This requires first insert slot 71 through which downstream inserts 70 are moved axially through or into insert slots 72 and 73. (The axial cooling passage through first rotor body projection otherwise could have been bored directly.) This approach works for inserts types with axial cooling channels 56 of both FIG. 5 and FIG. 6. The approach also works for full-fitting inserts with axial cooling holes 64 (FIG. 5, 6). To facilitate assembly, each insert and mating slot may be made slightly smaller than the insert and mating slot preceding it.

Figure 8:
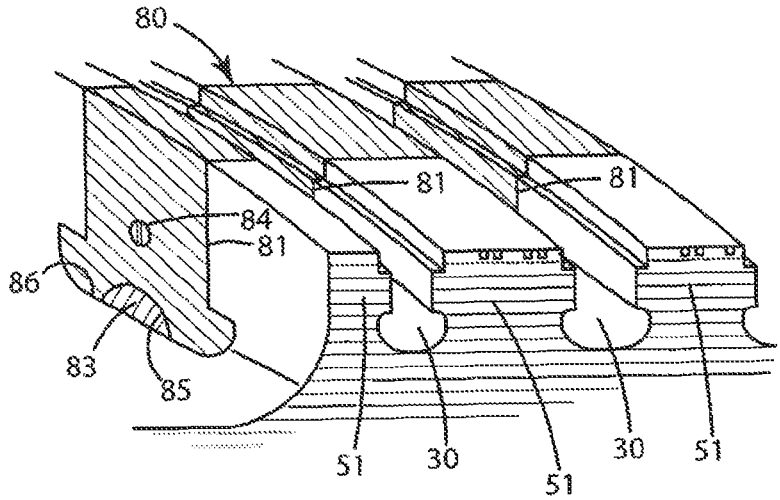
FIG. 8 illustrates a further embodiment of the present invention including a single axial insert that spans multiple stages.

FIG. 8 illustrates further embodiment of the present invention including a single axial insert that spans multiple stages. In this embodiment, the axial insert 80 spans three rotor body projections 51 and two tangential female dovetail slots 30. The axial female dovetail slot 81 is cut through each of the rotor body projections 51 and below the tangential female dovetail slot 30. The insert 80 may include a bottom cutout 83 forming a cooling passage through the rotor body projections 51. Alternatively, cooling holes 84 may be cut through the axial insert 80 or some combination of a bottom cutout cooling passage 83 and cooling holes 84 may be used. Cooling steam flows axially through the passage or holes to flood the circumferential dovetails as illustrated in FIG. 9).

Figure 9:
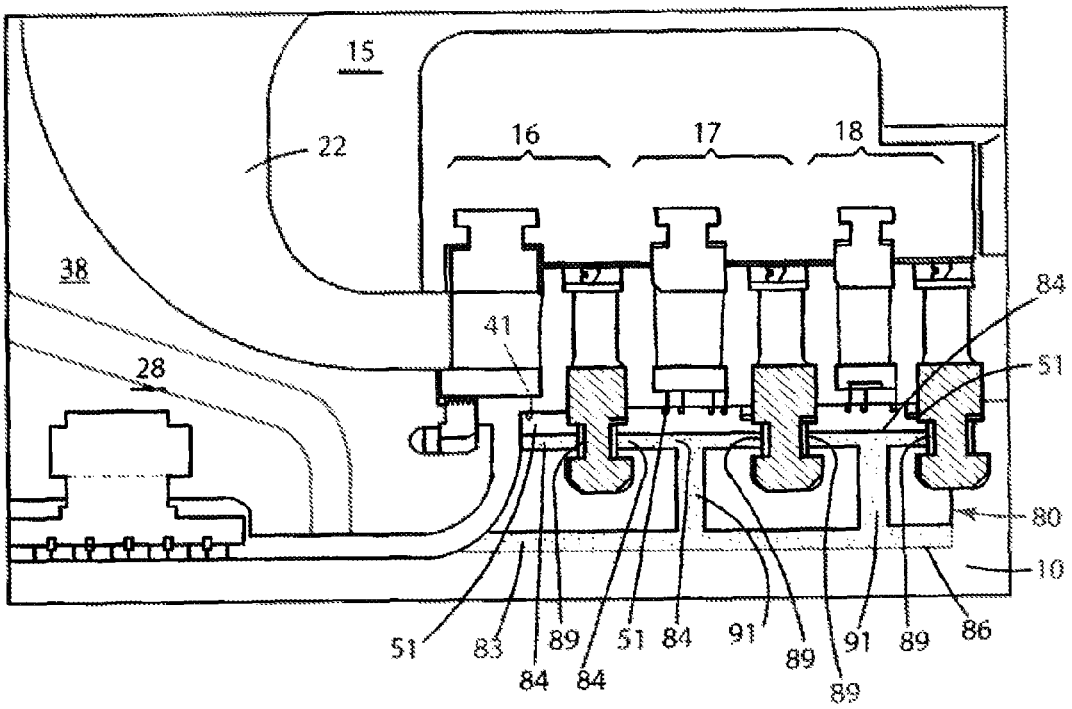
FIG. 9 illustrates a cut-away view of an embodiment of an axial insert that spans multiple stages.
Figure 10:
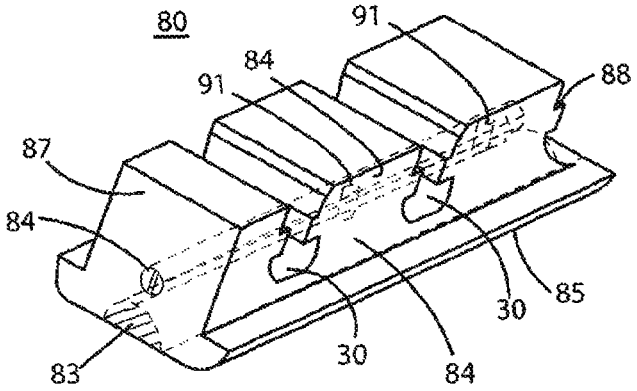
FIG. 10 illustrates a perspective view of an uninstalled axial insert for spanning multiple stages.

FIG. 9 illustrates a cut-away view of an embodiment of an axial insert that spans multiple stages. It is understood that such a depiction is exemplary and the axial insert is not limited to spanning three stages. The multi-stage axial insert 80, as shown, extends through the drum rotor projections 51 from stage one 16 to stage three 18. As with examples shown previously, a seal 41 may be provided. FIG. 9 illustrates a knife seal (41). Others seal, such as an overlap seal or brush seal could also be used. A first axial cooling passage 83 in the axial insert may be of the bottom slot type, between the bottom 85 of the insert 80 and the bottom 86 of axial dovetail 81, and extend from a forward end 87 to a back end 88. A second axial cooling passage 84 may extend along a length of the axial insert 80 at a radial height of the projection 54 of the circumferential female dovetail slot 30, thereby communicating with the circumferential dovetail cavities 89. The axial insert 80 may also include radial passages 91, thereby facilitating flow between the first axial cooling passage 83 and the second axial cooling passage 84. However, the axial cooling passages are not limited to interconnecting any specific number of stages. FIG. 10 illustrates an isometric view of the uninstalled axial insert 80 with tangential dovetail slots 30, axial cooling passages 83, 84. and radial cooling passage 91.

Figure 12:
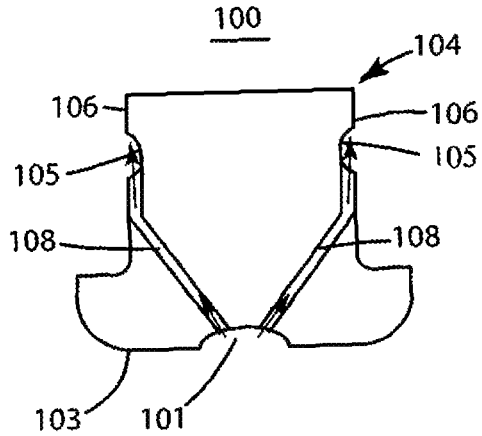
FIG. 12 illustrates and end view the alternative embodiment of the multi-stage axial insert of FIG. 10.
Figure 11:
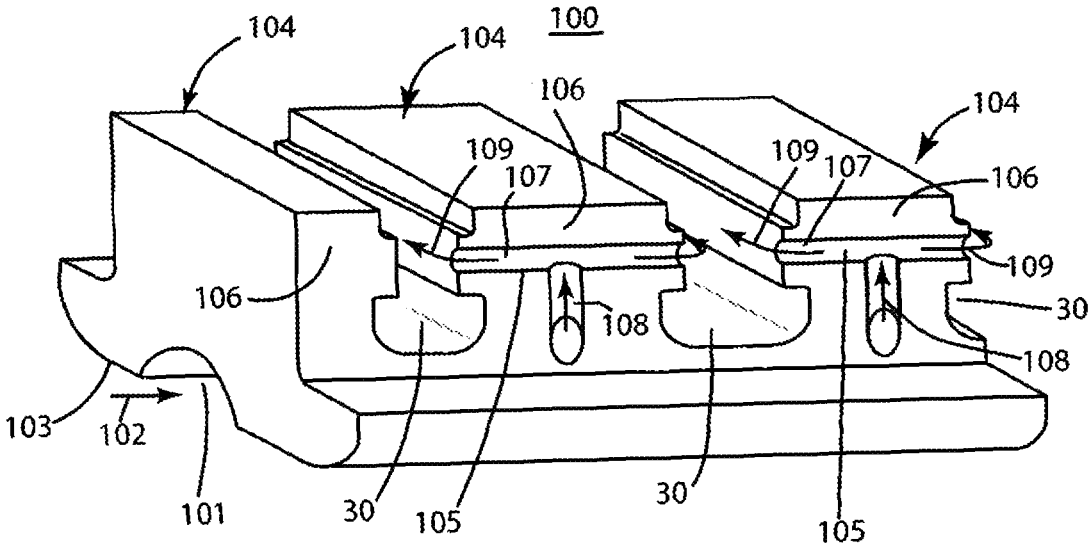
FIG. 11 illustrates an isometric view of an alternative embodiment of a multi-stage axial insert with radial cooling holes that does not include boring of long axial holes in the insert for the axial cooling passage.

FIG. 11 illustrates an isometric view of an alternative embodiment of a multi-stage axial insert 100 that does not include boring of long axial holes in the insert for the axial cooling passage. FIG. 12 illustrates a section view of the alternative embodiment of the multi-stage axial insert of FIG. 11. Axial insert 100 may include an axial recess 101 forming a first axial cooling passage 102 cut along bottom surface 103. The axial insert 100 includes tangential female dovetail slots 30 forming body projections 104. An axial recess 105 may be formed along tangential sides 106 providing second axial cooling passages 107. Fluid communication between the cooling passages 102 and 107 may be provided by internal channel 108. The cooling passages may be formed by milling or other suitable means. Where second axial cooling passages 107 intersect with tangential female dovetail slots 30, tangential cooling along the slots may be provided as illustrated and described above for FIG. 9 (89).

Figure 13:
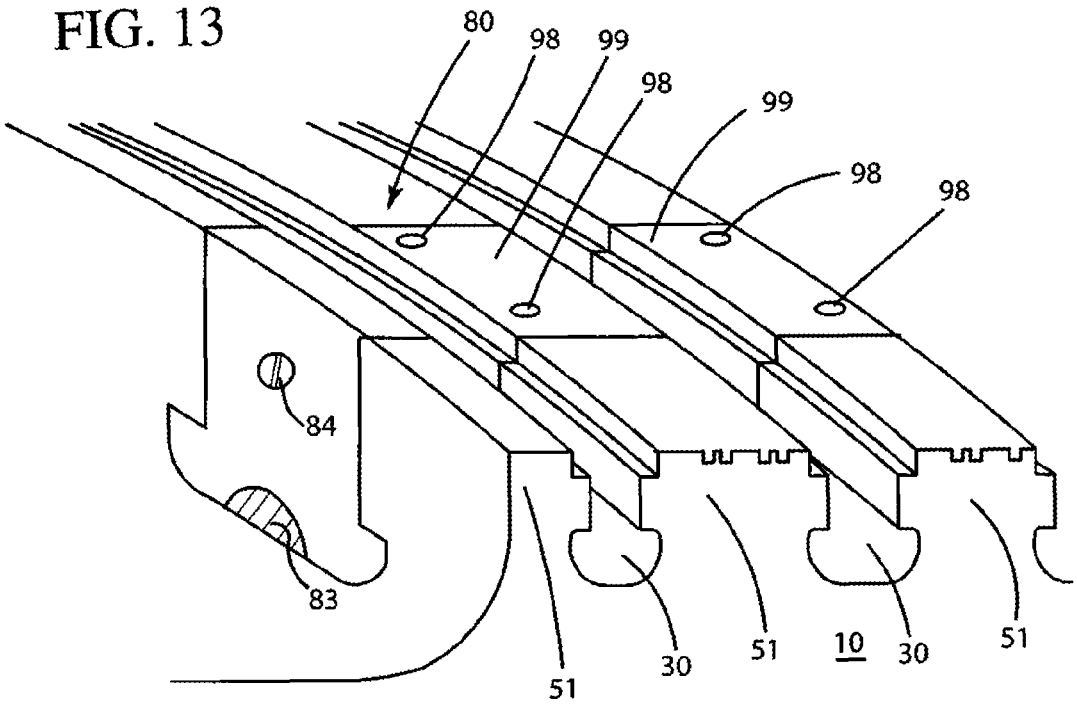
FIG. 13 illustrates radial cooling holes to the working steam space through an outer radial face of the axial insert.

In a further aspect of the present invention a discharge path into the working steam flow may be provided. FIG. 13 illustrates radial cooling holes 98 drilled through the outer radial face 99 of the axial insert 80 in the axial location of the rotor body projection 51. These radial cooling holes 98 can fluidly communicate with cooling passage 83 or 84 and to the circumferential cooling channel 89 described in FIG. 9. To ensure proper flow, it may be necessary to have some axial inserts 80 with bottom channel slots only and other inserts (at other circumferential positions) with exhaust holes 92 only.

Figure 14:
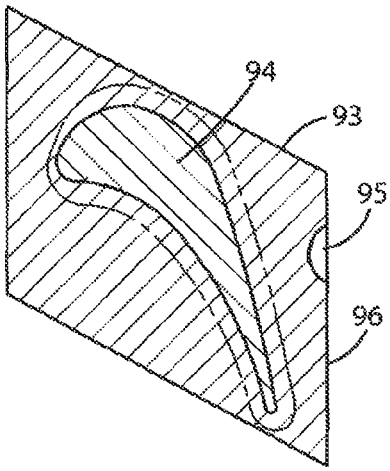
FIG. 14 provides a top view of a bucket platform and vane with a cooling steam discharge hole.
Figure 15:
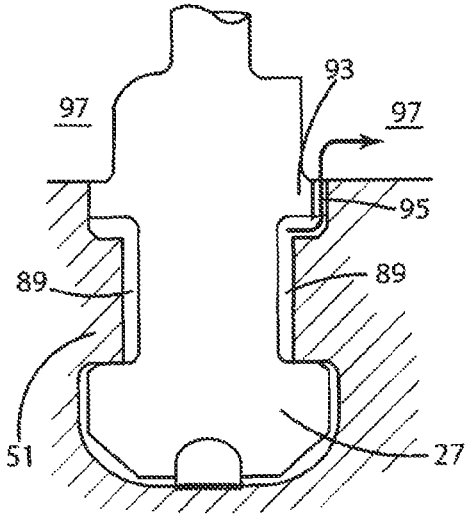
FIG. 15 illustrates the radial cooling steam discharge path between circumferential dovetail cavities into the working steam flow space above.

FIG. 14 and FIG. 15 illustrate a further aspect of the cooling path for the drum rotor wherein each bucket platform includes an opening through which coolant steam is exhausted into the working steam flowpath. FIG. 14 provides a top view of the bucket platform 93 and vane 94 with a cooling steam discharge hole 95. The discharge hole 95 is cut radially through the trailing edge 96 of the bucket platform. FIG. 14 illustrates the radial discharge hole 95 between circumferential dovetail cavities 89, through the bucket platform 93, and into the working steam flow space 97 above.

The axial cooling slots of FIGS. 9-13 may be used in conjunction with axial cooling holes formed between adjacent buckets for the axial path of cooling steam. Circumferential flow of cooling steam may be provided by circumferential slots between the forward face of the bucket root and the aft face of the rotor body projection and between the aft face of the bucket root and the forward face of the rotor body projection. The axial cooling slots through the rotor body projections and the axial cooling holes between adjacent buckets may be disposed circumferentially around the rotor wheel in sizes and locations dependent on the requirements for cooling flow in specific applications. The axial cooling slots or cooling holes created by the axial dovetail inserts may likely be the limiting flow area for the cooling system. The number and size of inserts and/or holes may be selected to allow enough flow for effective cooling. The ideal size and number of inserts/and or holes will depend on rotor thermal stresses, rotor mechanical stresses, and pressure drop through the passage.

Figure 16:
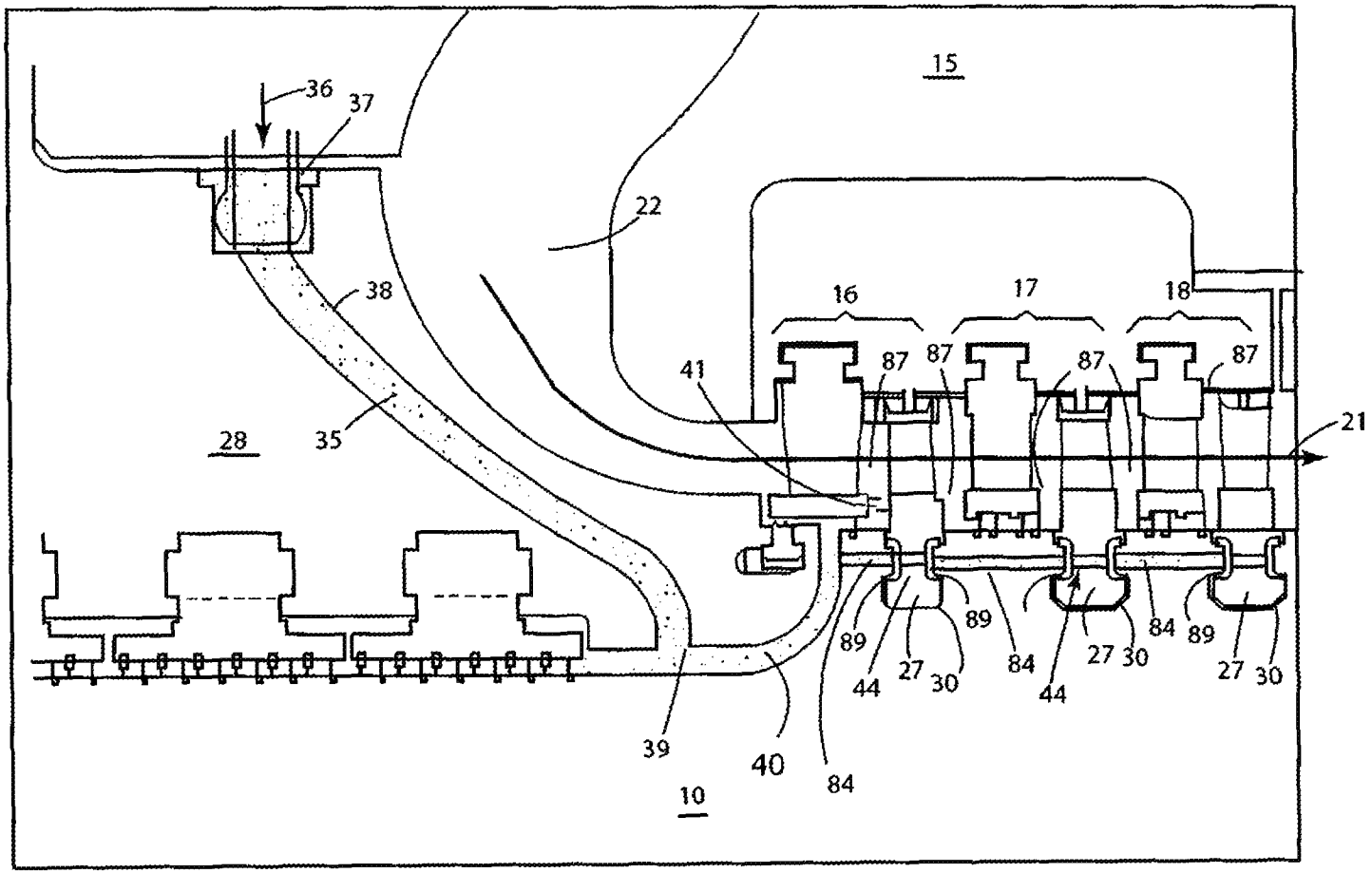
FIG. 16 illustrates a cooling steam flow from an external source delivered to locations in the drum rotor.

FIG. 16 illustrates a cooling steam flow from an external source delivered to locations in the drum rotor. External cooling steam 36 may flow through snout 37 and internal passage 38 opening into annulus 40 in drum rotor 10. Cooling steam may be blocked by overlap seal 41 and be channeled through axial holes 84 in drum rotor to circumferential cooling passages 89 between female dovetails slots and male dovetail bucket roots. Axial cooling passages 44 between adjacent buckets complete the axial cooling path.

While various embodiments are described herein, it will be appreciated from the specification that various combinations of elements, variations or improvements therein may be made, and are within the scope of the invention.

The invention claimed is:

1. A multi-stage steam turbine with a steam cooling circuit for multiple front stages of a drum rotor, the steam turbine comprising:

a drum rotor;

a cooling steam source;

a tangential female dovetail slot cut around an outer radial circumference for at least one of a plurality of stages of the drum rotor;

at least one axial female dovetail slot cut into at least one drum rotor projection between at least one of the plurality of stages of the drum rotor;

at least one axial male dovetailed insert conformed to insert into the at least one axial female dovetail slot; and an axial steam cooling passage formed at least one of through and around the axial male dovetailed insert, and wherein the axial cooling passage around the axial male dovetail includes a cutout portion at an inner radial end bounded by a base of the axial female dovetail slot.

2. The multi-stage steam turbine according to claim 1, wherein the axial cooling passage through the axial male dovetailed insert includes at least one axial hole through an axial length of the insert.

3. The multi-stage steam turbine according to claim 1, wherein a base of the axial female dovetail slot is disposed below a hook section of the tangential female dovetail slot.

4. The multi-stage steam turbine according to claim 1, wherein the at least one axial male dovetailed insert and the at least one axial female dovetail slot on the drum rotor projection are distributed circumferentially around the periphery of the drum rotor projection.

5. The multi-stage steam turbine according to claim 1, wherein the at least one axial male dovetailed insert includes a plurality of axial in-line inserts mounted in a plurality of axial in-line female dovetail slots of the plurality of drum rotor projections.

6. The multi-stage steam turbine drum rotor according to claim 1 wherein the at least one axial dovetailed insert extends axially along a plurality of in-line female dovetail slots disposed on the plurality of rotor projections.

7. The multi-stage steam turbine according to claim 6, wherein the axial dovetailed insert comprises:

a plurality of parallel axial cooling passages disposed at different radial heights within the axial dovetailed insert, the cooling passages further being disposed at common circumferential orientation; and at least one radial cooling passage disposed within at least one drum rotor projection and fluidly connecting the plurality of parallel axial cooling passages.

8. The multi-stage steam turbine according to claim 7, further comprising:

at least one radial cooling passage disposed within a portion of the axial dovetailed male insert occupying the space of the drum rotor projection, wherein the radial cooling passage fluidly connects a working steam space above the insert and an axial cooling passage within the insert.

9. The multi-stage steam turbine according to claim 1, further comprising:

a plurality of buckets with male dovetails disposed circumferentially in a circumferential female dovetail slots around at least one stage of the rotor wheel;

a vane platform on each bucket supporting a radially disposed vane; and a gap between an outer surface of the male dovetails of the plurality of buckets and the inner surface of circumferential female dovetail slots including a circumferential cooling path formed therebetween.

10. The multi-stage steam turbine according to claim 9, further comprising:

a cooling passage disposed through the vane platform between the circumferential cooling path and a working steam of the bucket.

11. The multi-stage steam turbine according to claim 1, wherein the cooling steam source comprises: an external cooling steam source.

12. The multi-stage steam turbine according to claim 11, wherein the external cooling steam source comprises: a cooling steam source supplied through a leakoff annulus of a first stage.

13. A cooling circuit for a multi-stage steam turbine with a drum rotor including buckets mounted in a tangential female dovetail slot for at least one stage, the cooling circuit comprising:

an external source for a cooling steam;

a drum rotor;

an internal passage for the external cooling steam to a space in proximity to the first stage of the steam turbine drum rotor;

a tangential female dovetail slot cut around an outer radial circumference for at least one of a plurality of stages of the drum rotor;

a plurality of buckets with male dovetails disposed circumferentially in the tangential female dovetail slot around at least one stage of the rotor wheel;

a vane platform on each bucket supporting a radially disposed vane; and a gap between an outer surface of the male dovetails of the plurality of buckets and the inner surface of tangential female dovetail slots including a circumferential cooling path formed therebetween around the drum rotor projections;

at least one axial female dovetail slot cut into at least one drum rotor projection between at least one of the plurality of stages of the drum rotor;

at least one axial male dovetailed insert conformed to insert into the at least one axial female dovetail slot;

an axial steam cooling passage formed at least one of through and around the axial male dovetailed insert, wherein the axial steam cooling passage delivers cooling steam to circumferential cooling path around the drum rotor projections; and a vane platform on the plurality of buckets including a cooling passage disposed through the vane platform between the circumferential cooling path and a working steam space above the bucket, wherein the at least one axial male dovetailed insert extends axially through a plurality of drum rotor projections of successive turbine stages.

14. The cooling circuit according to claim 13, wherein the at least one axial male dovetailed insert are disposed circumferentially around the drum rotor projection of at least one turbine stage.

15. A multi-stage steam turbine with a steam cooling circuit for multiple front stages of a drum rotor, the steam turbine comprising:

a drum rotor;

a cooling steam source;

a tangential female dovetail slot cut around an outer radial circumference for at least one of a plurality of stages of the drum rotor;

at least one axial female dovetail slot cut into at least one drum rotor projection between at least one of the plurality of stages of the drum rotor;

at least one axial male dovetailed insert conformed to insert into the at least one axial female dovetail slot; and an axial steam cooling passage formed at least one of through and around the axial male dovetailed insert, wherein a base of the axial female dovetail slot is disposed within a hook section of tangential female dovetail slot.

* * * * *